US006042220A

United States Patent [19]

Wakahara et al.

[11] Patent Number: 6,042,220

[45] Date of Patent: Mar. 28, 2000

[54] IMAGE FORMING DEVICE FORMING AN IMAGE ON A RECORDING MEDIUM USING FLYING DEVELOPER

[75] Inventors: Shirou Wakahara, Osaka; Yasuichi Onose, Sakurai; Kazuya Masuda, Nara; Kenji Tani, Yamatokoriyama; Hajime Yoshinaga, Ikoma-gun, all of Japan

[73] Assignee: Sharp Kabushiki Kaisha, Osaka, Japan

[21] Appl. No.: 09/032,872

[22] Filed: Mar. 2, 1998

[30] Foreign Application Priority Data

Mar. 5, 1997 [JP] Japan ..... 9-050791

[51] Int. Cl.[7] ..... B41J 2/06

[52] U.S. Cl. ..... 347/55; 347/141

[58] Field of Search ..... 347/55, 141, 144, 347/147, 151; 399/291, 293, 55

[56] References Cited

U.S. PATENT DOCUMENTS 5,781,218 7/1998 Wakahara et al. ..... 347/55 X
5,825,384 10/1998 Fujita ..... 347/55

OTHER PUBLICATIONS

Japanese KOKAI (Published unexamined patent application) No. 286204/1994 (Tokukaihei 6–286204, Published date: Oct. 11, 1994).

*Primary Examiner*—William Royer
*Assistant Examiner*—Hoan Tran
*Attorney, Agent, or Firm*—Dike, Bronstein, Roberts & Cushman, LLP; David G. Conlin; William J. Daley, Jr.

[57] ABSTRACT

In a digital printer as an image forming device, a high voltage is applied to a counter electrode exclusively when the counter electrode is covered with a sheet of paper having a good insulating property, so that a strong electric field necessary for image formation is generated between the counter electrode and a toner carrier. When the counter electrode is not covered with a sheet of paper, a high voltage relay provided between the counter electrode and a high voltage power source is turned OFF so that the application of the high voltage to the counter electrode is suspended, so that the strong electric field is not generated. By doing so, it is possible to surely avoid discharge which tends to occur between the counter electrode and the toner carrier or between the counter electrode and the control electrode.

14 Claims, 11 Drawing Sheets

IMAGE FORMING DEVICE FORMING AN IMAGE ON A RECORDING MEDIUM USING FLYING DEVELOPER

FIELD OF THE INVENTION

The present invention relates to an image forming device for use in a printing unit of a digital copying machine or a facsimile machine, a digital printer or a plotter as an outputting device for a computer or a word processor, or the like, which is arranged so that an image is formed on a recording medium by flying a developer thereto.

BACKGROUND OF THE INVENTION

Conventionally, a device for forming an image by flying toner directly onto a recording medium has been well known as an image forming device for forming a visual image on a recording medium such as paper in response to an image signal (as disclosed by, for example, the Japanese Publication for Laid-Open Patent Application No. 6-286204/1994 (Tokukaihei 6-286204)). In an image forming device of this type, a toner carrier and a counter electrode are arranged vis-a-vis each other, and a control electrode having a plurality of passing pores (hereinafter referred to as gates) is provided therebetween. The image forming device controls the flight of the toner by controlling an electric field formed between the toner carrier and the control electrode by changing a voltage applied to the control electrode, and at the same time it causes the toner to reach a surface of a recording medium by using a strong electric field formed by the counter electrode, thereby forming an image on the recording medium.

The image forming device of this type forms an image directly on the recording medium, and hence it does not necessitate a photoconductive body and a visualizing body such as a dielectric drum which are used in conventional image forming devices. Therefore, a transfer operation for transferring an image from the visualizing body onto the recording medium is omitted, and hence the device causes no deterioration of the image, thereby resulting in improvement of the reliability of the device. Moreover, the arrangement of the device is simplified and the number of constituent parts is decreased, which results in reduction of the size of the device and lowering of the price of the device.

However, the conventional image forming device has a drawback in that discharge tends to occur between the counter electrode and the control electrode, or between the counter electrode and the toner carrier, which causes various problems to the device.

More specifically, a high voltage such as 1 kV to 2 kV is usually applied to the counter electrode. Since the counter electrode is provided close to the control electrode, or close to the toner carrier, normally with a distance therebetween of several millimeters, or sometimes with such a short distance as several hundred micrometers, discharge is easily caused therebetween by the high voltage. Therefore, even if the strength of the electric field between the counter electrode and the control electrode or the toner carrier is not greater than a dielectric strength, when paper dusts or unnecessary toner, or other impurities adhere to the counter electrode, the control electrode, or a toner layer on a surface of the toner carrier, the electric field concentratively affects the paper dusts or the like, easily causing insulation breakdown, resulting in discharge. As a result, a surface of the counter electrode, the toner carrier, or the control electrode is broken down.

The image forming device disclosed in the aforementioned publication is arranged so that when a sheet of paper ("substrate" in the publication) passes above the gates ("opening parts" in the publication) of the control electrode ("aperture electrode" in the publication), application of a high voltage to the counter electrode starts, and then, when the image formation based on image data for one page finishes, the control electrode is controlled so as to have an OFF potential, while the application of the high voltage to the counter electrode is suspended. Therefore, as compared with an arrangement wherein a high voltage is applied to the counter electrode without cessation, this image forming device is able to suppress the occurrence of discharge to some extent, but not completely.

The image forming device disclosed in the above publication is arranged so that even if a dimension of paper used in a direction orthogonal to a transporting direction is smaller than a dimension of the counter electrode in the same direction, a high voltage is applied throughout the counter electrode. Therefore, in the image forming device, in case of paper with specific dimensions, the counter electrode has a large exposed portion (a part uncovered with the paper), and it is impossible to avoid discharge occurring in the vicinity of this portion.

If discharge occurs, for example, on the surface of the counter electrode, a part of the surface of the counter electrode tends to be recessed, and moreover, a part surrounding the recessed part rises, thereby forming a protuberance. As a result, smooth transport of the recording medium becomes impossible. Besides, this causes such inconvenience as toner adheres to such recessed parts and soils a reverse surface of the recording medium.

Furthermore, if the discharge occurs on the surface of the toner carrier, the surface of the toner carrier tends to have recessed parts and protuberances, like in the case of the counter electrode. In this case, an adequate toner layer is not formed in areas where recessed parts and protuberances are formed, and this prevents toner from having desired properties, thereby making it difficult to control the toner flight. As a result, a good image forming operation cannot be achieved, thereby causing deterioration of image quality.

In addition, if the discharge occurs on the surface of the control electrode, as in the above case, the surface of the control electrode, that is, an insulating layer, is broken, and electrodes which are elements of the control electrode are exposed. If the toner adheres to the exposed control electrode, the potential of the control electrode changes from an appropriate value, due to electric charge that the toner has. As a result, desired control of the toner flight becomes difficult, and an adequate image forming operation cannot be achieved, thereby causing deterioration of image quality.

Furthermore, since protuberances formed on the control electrode, the toner carrier, or the counter electrode due to the discharge sharply extrude, these protuberances tend to cause secondary inconveniences such as another induction of discharge.

In the case where the discharge occurs on the surface of the toner carrier, control of the toner flight becomes impossible due to electric charge generated due to the discharge and shocks caused by the discharge, and even if a voltage which does not cause the toner to fly is applied to the control electrode, flight of toner to the control electrode or the counter electrode occurs.

Then, if another discharge occurs in this condition, the toner melts due to the discharge, and becomes fixed on the surface of the counter electrode, the toner carrier, or the control electrode. In such a case, the following inconveniences become conspicuous: smooth transport of a recording medium is hindered; and a reverse surface of the recording medium is soiled.

Furthermore, in the case where recessed parts or protuberances are formed, or the toner is fixed, on the surface of the control electrode, the toner carrier, or the counter electrode, adequate image formation cannot be conducted unless the member is replaced.

On the other hand, the discharge is also a factor causing electric noises. The noise generated due to the discharge is extremely strong and has a frequency ranging extremely widely. Therefore, there may occur an inconvenience that the control circuit catches the noise and erroneously operates, or the like. As a result, abnormal heat emission in a fixing section, or malfunction of a driving section, may be induced.

Besides, if discharge occurs, an electric current of a high voltage or a great electric current may possibly run directly into a power source that supplies desired voltages to members involved in the discharge, breaking electrodes of the power source and other control circuits.

Furthermore, when the conventional image forming device is connected with another apparatus, such as a host computer, the abnormal electric current runs through cables or the like thereto, possibly breaking the host computer.

Usually the above inconveniences are deemed avoidable by insulating the counter electrode, the toner carrier, or the control electrode. However, it should be noted that if a protective layer with a high resistance is formed on a surface of the counter electrode or the toner carrier, electric charge is generated on a surface of the protective layer due to friction of the protective layer with a recording medium or the toner, and the electric charge is accumulated in the protective layer, thereby, by taking the toner carrier as an example, making it impossible to confer appropriate properties on the toner and the toner layer. In the case of the counter electrode, a desirable electric field cannot be formed due to the potential of the electric charge. As a result, the control of the toner flight becomes difficult, and in a worst case, images cannot be formed.

On the other hand, in the case where to avoid the above problem, the resistance of the protective layer is lowered so as to neutralize the electric charge generated on the surface of the protective layer, the protection effect against discharge lowers. Moreover, in the case where the protective layer is formed on the surface of the toner carrier in the image forming device as represented by the above prior art, the protective layer has to be formed very thin, since the gap between the toner carrier and the control electrode is very narrow. Therefore, the protection effect of the protective layer against discharge becomes further lower. On top of that, since the toner carrier is always subjected to friction with toner and electric charge is accumulated therein, it is impossible to maintain the protective layer in a good condition due to its service life, thereby resulting in that control for forming a stable toner layer is difficult. For these reasons, under the present conditions, a protective layer cannot be provided on the toner carrier.

SUMMARY OF THE INVENTION

The object of the present invention is to provide an image forming device which is capable of surely avoiding discharge between the counter electrode and the control electrode, or between the counter electrode and the toner carrier.

To achieve the above object, the image forming device of the present invention has (1) a carrier for carrying a developer, (2) a counter electrode provided vis-a-vis the carrier, and (3) a control electrode provided between the carrier and the counter electrode, the control electrode having a plurality of gates each being composed of a piercing pore and a plurality of electrodes for individually controlling passages of the developer through the gates, wherein the developer is caused to fly from the carrier to the counter electrode by an electric field generated between the carrier and the counter electrode, while the passage of the developer through the gates is controlled by an electric field generated between the carrier and control electrode, so that an image is formed on a surface of a recording medium being transported between the control electrode and the counter electrode, with the developer caused to adhere thereto, and the image forming device is characterized in comprising electric field control means for controlling the electric field generated between the counter electrode and the carrier or between the counter electrode and the control electrode, so that (i) a strength of the electric field becomes a level necessary for image formation exclusively in case the recording medium covers an effective region of the counter electrode, and (ii) in the other cases, the strength thereof are weakened to a level lower than the level necessary for image formation, or the electric field per se is eliminated.

According to the aforementioned arrangement, the electric field control means controls the electric field generated between the counter electrode and the carrier or between the counter electrode and the control electrode so that (i) the electric field has a strength necessary for image formation exclusively when the recording medium covers the effective region of the counter electrode, while (ii) at other times, the strength of the electric field is weakened to a level lower than that necessary for image formation, or the electric field is eliminated. Note that the effective region is a region in the counter electrode facing the carrier and the control electrode, where discharge may possibly occur. Therefore, the effective region varies depending on a shape of the counter electrode, and in some cases a whole surface of the counter electrode constitutes the effective region while in other cases a part of the surface of the counter electrode constitutes the same.

Accordingly, whenever a strong electric field necessary for image formation is formed, whereby high insulation is required, the recording medium is made to lie between the control electrode and the counter electrode. With this arrangement, occurrence of discharge between the counter electrode and the carrier or between the counter electrode and the control electrode is surely avoided, even though the insulation therebetween is poor. In other words, in the effective region of the counter electrode, the strong electric field necessary for image formation is formed between the counter electrode and the carrier or between the counter electrode and the control electrode exclusively in the case the effective region is covered with the recording medium, and in the other cases the strong electric field is not formed. Therefore, there is no need to provide the counter electrode, the carrier, the control electrode, and the like, with either an insulating member having a high resistance or a thick insulating member additionally. Therefore, by arranging the image forming device as above, occurrence of discharge which may break such members is surely avoided with such simple arrangement.

Furthermore, to achieve the aforementioned object, the image forming device of the present invention has (1) a carrier for carrying a developer, (2) a counter electrode provided vis-a-vis the carrier, and (3) a control electrode provided between the carrier and the counter electrode, the control electrode having a plurality of gates each being composed of a piercing pore and a plurality of electrodes corresponding to the gates respectively for controlling passage of the developer through the gates, wherein the developer is caused to fly from the carrier to the counter electrode by an electric field generated between the carrier and the counter electrode, while the passage of the developer through the gates is controlled by an electric field generated between the carrier and control electrode, so that an image is formed on a surface of a recording medium being transported between the control electrode and the counter electrode, with the developer caused to adhere thereto, and the image forming device is characterized in comprising electric field region changing means for changing a size of an electric field region where the electric field between the counter electrode and the carrier or between the counter electrode and the control electrode necessary for image formation is generated, so that the size selected is in conformity with a dimension of the recording medium in a direction orthogonal to a recording medium transporting direction.

According to the above arrangement, the electric field region changing means changes the size of the region of the electric field necessary for image formation, which is generated between the counter electrode and the carrier or between the counter electrode and the control electrode, so that the size of the region becomes in conformity with the dimension of the recording medium in a direction orthogonal to the recording medium transporting direction. Therefore, even in the case where the dimension of the recording medium in this direction is shorter than the dimension of the counter electrode in this direction, the electric field necessary for image formation is generated exclusively on a portion of the counter electrode where the recording medium is present. By doing so, it is possible to surely avoid occurrence of discharge between the counter electrode and the carrier or between the counter electrode and the control electrode. Therefore, there is no need to provide the counter electrode, the carrier, the control electrode, and the like, with an insulating member having a high resistance or a thick insulating member additionally. Therefore, by arranging the image forming device as above, occurrence of discharge which may break such members is surely avoided with such simple arrangement.

For a fuller understanding of the nature and advantages of the invention, reference should be made to the ensuing detailed description taken in conjunction with the accompanying drawings.

DESCRIPTION OF THE PREFERRED EMBODIMENTS

The following description will explain an embodiment of the present invention, while referring to FIGS. 1 through 13. Note that in the present embodiment, an image forming device in which negatively-charged toner is used is taken as an example, and polarities of applied voltages are set in accordance with it. Therefore, in the case where positively-charged toner is used, appropriate arrangements and polarities of applied voltages may be set in accordance with properties of the positively-charged toner.

Figure 1:
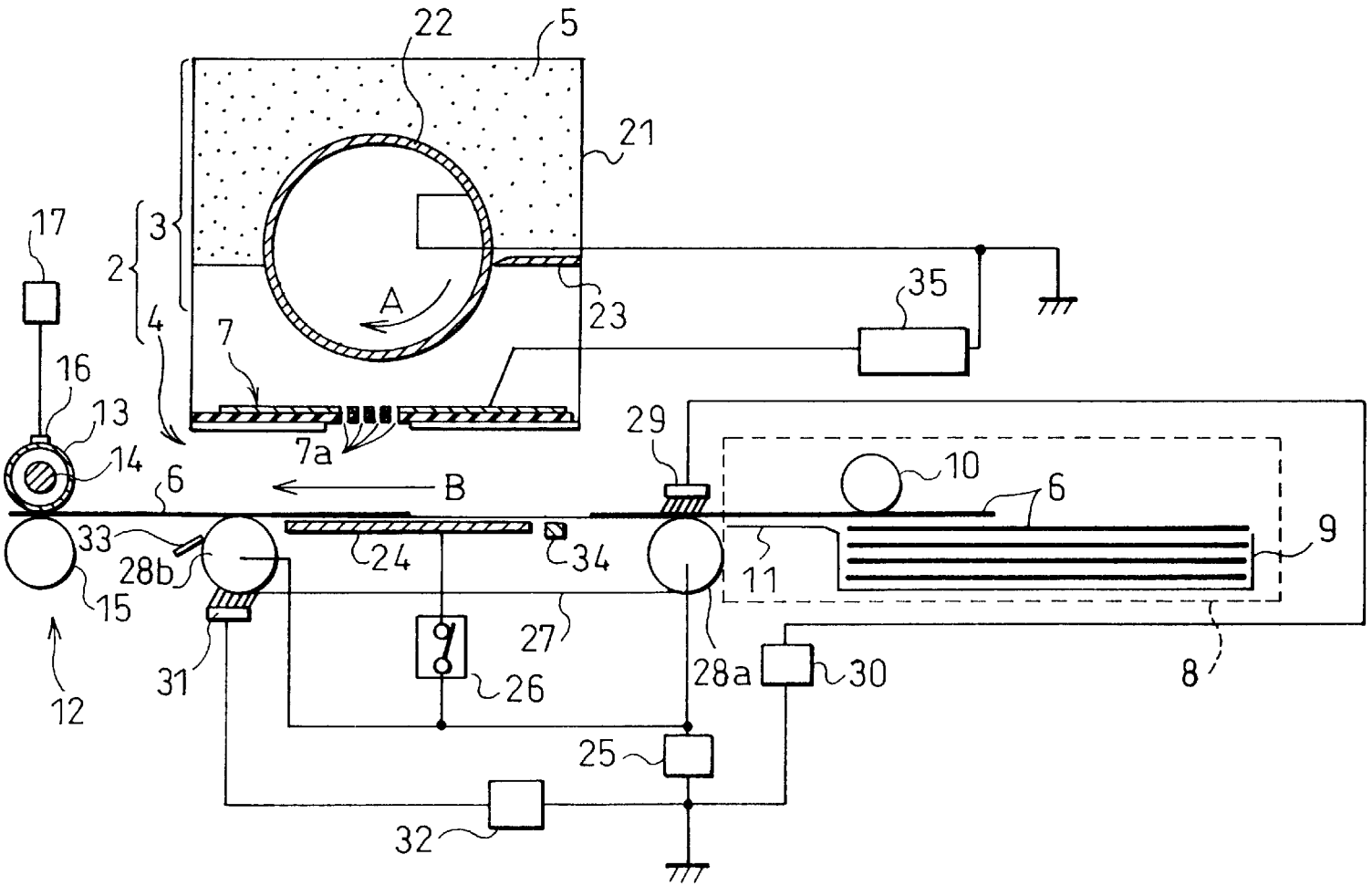
FIG. 1 is a view illustrating an arrangement of principal parts of a digital printer as an image forming device in accordance with an embodiment of the present invention.
Figure 2:
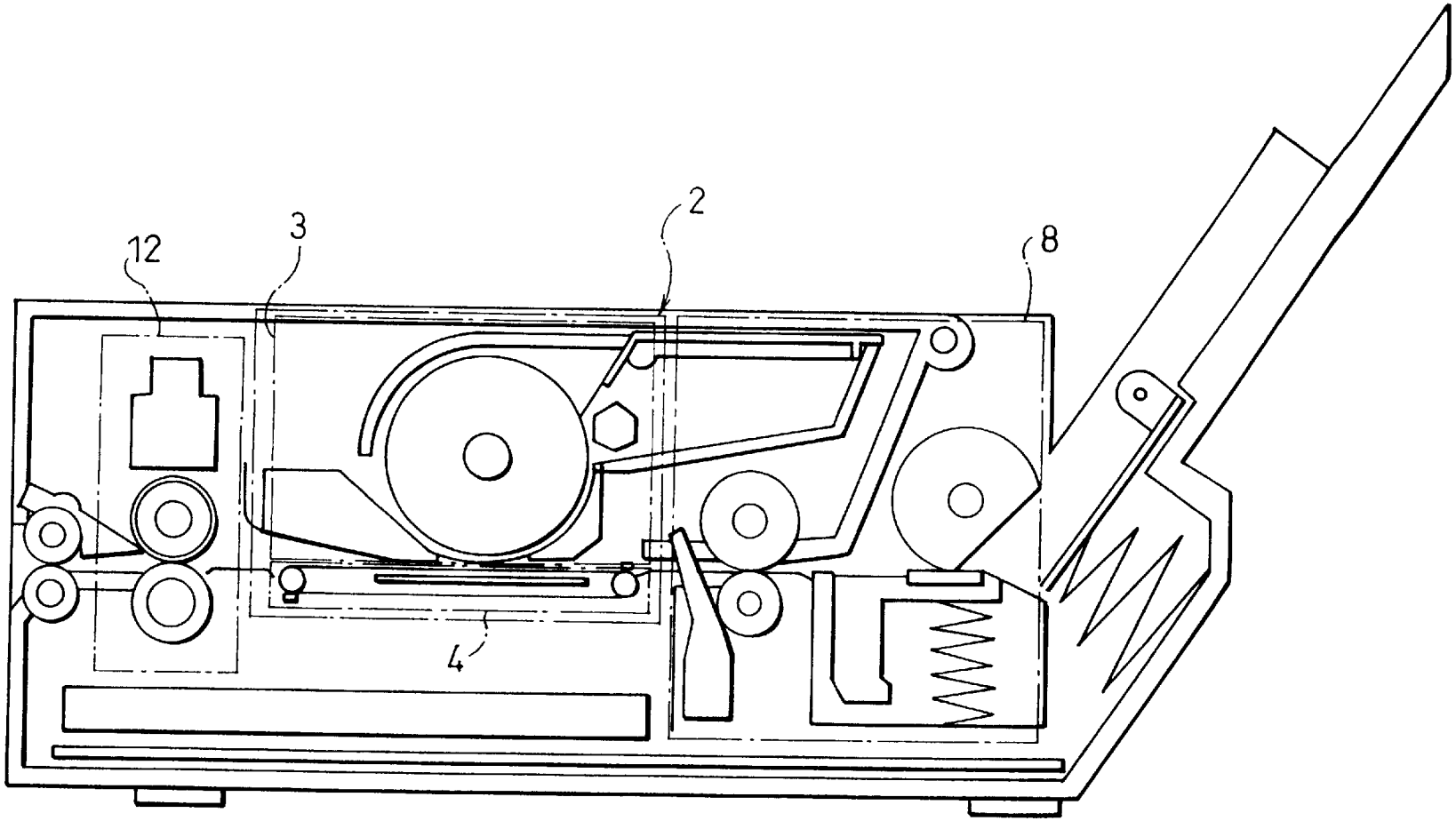
FIG. 2 is a view illustrating an arrangement of the digital printer.

A digital printer as an image forming device of the present embodiment is equipped with an image forming unit 2 having a toner supply section 3 and a printing section 4, as illustrated in FIGS. 1 and 2. And, a transport path through which a sheet of paper 6 (hereinafter referred to as a sheet 6) is transported is formed from a paper feed unit 8 through the image forming unit 2 to a fixing unit 12.

In the printing section 4 in the image forming unit 2, an image is formed directly on the sheet 6 transported thereto, by flying toner (developer) 5 supplied from the toner supply section 3. Here, to form an image in accordance with image data, the flight of toner 5 is controlled by a control electrode 7.

Note that in the present image forming device, there are provided a main control unit, an image processing unit, an image memory, and an image formation control unit as control system, though they are not shown. The main control unit controls the whole image forming device. The image processing unit converts given image data into image data of a suitable type for printing (image signal). The image memory stores the image data thus converted. The image formation control unit converts the image data supplied from the image processing unit to an image signal to be fed to the control electrode 7.

As shown in FIG. 1, on a paper feed side of the image forming unit 2, a paper feed unit 8 is provided. The paper feed unit 8 is composed of a paper cassette 9, a pickup roller 10, a paper guide 11, and a paper feeding sensor (not shown). The paper cassette 9 contains a plurality of sheets 6 as recording media. The pickup roller 10 is driven so as to rotate and sends out a sheet 6 from the paper cassette 9. The paper guide 11 guides the sheet 6 thus fed. The paper feeding sensor detects that the sheet 6 is fed.

On the other hand, on a paper discharging side of the image forming unit 2, a fixing unit 12 is provided. The fixing unit 12 applies heat and pressure to a toner image formed on the sheet 6 in the image forming unit 2 so that the toner image is fixed on the sheet 6. The fixing unit 12 is equipped with a heating roller 13, a heater 14, a pressure roller 15, a temperature sensor 16, and a temperature control circuit 17.

The heating roller 13 is composed of an aluminum tube which is 2 mm thick, in which the heater 14 using a halogen lamp is installed. The pressure roller 15 is made of silicone resin. However, this arrangement is merely one example, and the sizes, materials, and structures of the heating roller 13, the heater 14, and the pressure roller 15 are not limited to those of the above example.

The heating roller 13 and the pressure roller 15 are provided vis-a-vis each other, and a load of 2 kg is applied by springs (not shown) or the like fixed to ends of each axis of the rollers, so that the sheet 6 is nipped therebetween and a pressure is applied thereto. The temperature sensor 16 measures the surface temperature of the heating roller 13. The temperature control circuit 17 is controlled by the main control unit, so as to control the heater 14 in accordance with a measurement result of the temperature sensor 16, whereby the surface temperature of the heating roller 13 is kept at 150° C. Note that the surface temperature is determined in accordance with melting properties of the toner 5 used, and it is not limited to the above temperature. Besides, the fixing unit 12 may be arranged so as to fix a toner image on the sheet 6 either only by heating it, or only by applying pressure thereto.

The heating roller 13 and the pressure roller 15 are driven to rotate in a direction of discharging the sheet 6 (indicated by an arrow B in FIG. 1) by a drive unit which is not shown. Besides, on a side of the fixing unit 12 where the sheet 6 is discharged, a paper discharge tray, a paper discharge roller, and a paper discharge sensor are provided. The paper discharge tray receives the sheet 6 which has been processed by the fixing unit 12. The paper discharge roller is driven to rotate in a direction such that the sheet 6 is discharged onto the paper discharge tray, so as to discharge the sheet 6. The paper discharge sensor detects that the sheet 6 is normally discharged.

The following description will explain an arrangement of the image forming unit 2 in detail.

As shown in FIG. 1, the toner supply section 3 in the image forming unit 2 is composed of a toner containing vessel 21, a toner carrier (carrier) 22 in a cylindrical shape, and a doctor blade 23. In the toner containing vessel 21, black toner 5 is stored. The toner carrier 22 is installed in the toner containing vessel 21, so as to carry the toner 5. The doctor blade 23 charges the toner 5, while controls a thickness of a layer of the toner 5 carried on a circumferential surface of the toner carrier 22.

The toner carrier 22 is grounded, and is driven by a drive unit, not shown, so as to rotate in a discharging direction of the sheet 6 (indicated by an arrow A in FIG. 1) so that a rotational speed of the circumferential surface is 80 mm/sec. The doctor blade 23 is provided on an upstream side of the toner carrier 22 in a rotational direction thereof, with a distance of 60 $\mu$m from the circumferential surface of the toner carrier 22. A mean particle diameter of the toner 5 is 6 $\mu$m, and the toner 5 is charged by the doctor blade 23 so as to have a charge quantity of −4 $\mu$C/g to −5 $\mu$C/g.

Note that a force of the toner carrier 22 for carrying the toner 5 (hereinafter referred to as toner carrying force) is generated by either the magnetic force, the electrostatic force, or a combination of the magnetic force and the electrostatic force. Besides, the rotational speed of the toner carrier 22, the mean particle diameter of the toner 5, the distance between the doctor blade 23 and the toner carrier 22, the quantity of charge given to the toner, and the like are determined depending on specification of the individual image forming device, and are not limited to the aforementioned values.

On the other hand, in the printing section 4 of the image forming unit 2, there is provided a counter electrode 24 made of, for example, an aluminum plate with a thickness of 1 mm. The control electrode 7 is installed between the counter electrode 24 and the toner carrier 22. In addition, in the printing section 4, there are installed a high voltage power source 25, a high voltage relay 26, a dielectric belt 27, supporting members 28*a* and 28*b*, a charging brush 29, a charging power source 30, a charge removing brush 31, a charge removing power source 32, and a cleaning blade 33. The high voltage power source 25 supplies a high voltage to the supporting members 28*a* and 28*b*, while supplies a high voltage to the counter electrode 24 through the high voltage relay 26. The high voltage relay 26 as switching means conducts an ON-OFF control of application of a high voltage to the counter electrode 24. The dielectric belt 27 causes the sheet 6 to adhere thereto electrostatically, so as to transport the sheet 6. The supporting members 28*a* and 28*b* support the dielectric belt 27. The charging brush (charging means) 29 charges the dielectric belt 27 or the sheet 6, or the both. The charging power source 30 applies a charging voltage to the charging brush 29. The charge removing brush 31 removes charge from the dielectric belt 27. The charge removing power source 32 applies a charge removing voltage to the charge removing brush 31. The cleaning blade 33 cleans a surface of the dielectric belt 27. In addition, on an upstream side of the counter electrode 24 in a direction in which the sheet 6 is transported (hereinafter referred to as sheet transporting direction), there is provided a paper detecting sensor (detecting means) 34 for detecting whether the sheet 6 exists or not. Therefore, the main control unit, the high voltage relay 26, and the like constitute electric field control means. Besides, the pickup roller 10, the main control unit, the charging brush 29, and the like constitute transporting means.

The counter electrode 24 is arranged vis-a-vis the circumferential surface of the toner carrier 22 so as to have a minimum distance therefrom of 1.1 mm. To the counter electrode 24, a high voltage of 2.3 kV is applied by the high voltage power source 25. With the application of the high voltage, a strong electric field is generated which is necessary for causing the toner 5 carried on the toner carrier 22 to fly toward the counter electrode 24.

The dielectric belt 27 is formed, for example, by using PVDF (polyvinylidene difluoride) as material, so as to have a volume resistance of $10^{10}$ Ω·cm and a thickness of 75 $\mu$m. The dielectric belt 27 is driven by a drive unit (not shown) in the sheet transporting direction (indicated by an arrow B in FIG. 1) so that a surface speed becomes 30 mm/sec.

The charge removing brush 31 is provided on a downstream side of the control electrode 7 in a moving direction of the dielectric belt 27, so that it contacts and presses the dielectric belt 27. To the charge removing brush 31, a charge removing voltage of 2.5 kV is applied by the charge removing power source 32. With this arrangement, the charge removing brush 31 removes unnecessary charge existing on a surface of the dielectric belt 27.

When paper jam or other unexpected events cause the toner 5 to adhere to the surface of the dielectric belt 27, the cleaning blade 33 removes the toner 5 so as to prevent the toner 5 from soiling a reverse surface of the sheet 6.

Note that in the above arrangement, the material of the counter electrode 24, the voltage applied to the counter electrode 24, the distance between the counter electrode 24 and the toner carrier 22, the surface speed of the dielectric belt 27, and the like are matters desirably determined respectively depending on specification of an individual image forming device, and they are not limited to the values mentioned above.

The control electrode 7 is provided so as to have a minimum distance of 100 μm from the circumferential surface of the toner carrier 22 and so as to be parallel with the counter electrode 24. The control electrode 7 planarly extends, facing the counter electrode 24. The control electrode 7 is provided with gates 7*a* through which the toner 5 passes from the toner carrier 22 toward the counter electrode 24. The control electrode 7 is arranged so as to alter, in accordance with the voltage supplied, the electric field applied to the surface of the toner carrier 22, and control the flight of the toner 5 passing through the gates 7*a* from the toner carrier 22 toward the counter electrode 24.

Figure 3:
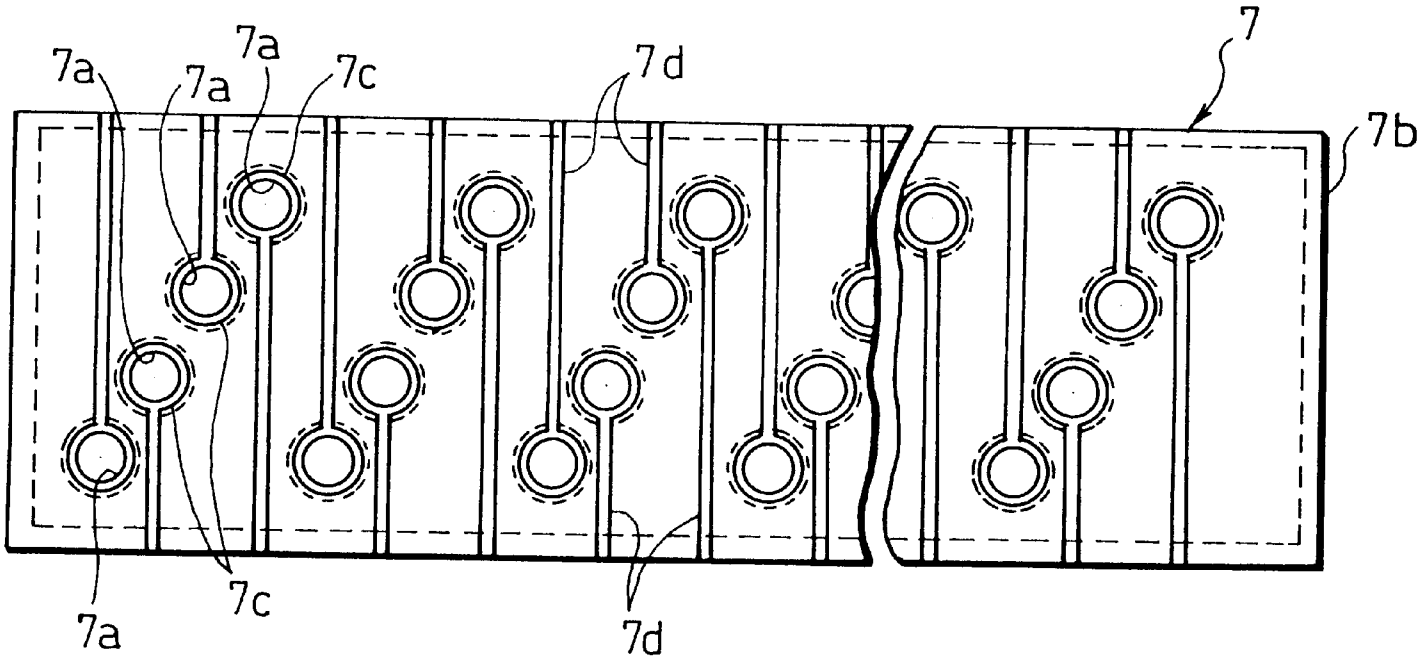
FIG. 3 is a plan view illustrating a control electrode provided in the digital printer.

As shown in FIG. 3, the control electrode 7 is composed of (1) an insulating substrate 7*b* made of polyimide resin to a thickness of 25 μm and (2) ring-shape electrodes (hereinafter referred to as ring electrodes) 7*c* on the insulating substrate 7*b* which are independent to each other. Each ring electrode 7*c* is equipped with a power supply line 7*d* which is a conductive line for supplying a control voltage. The power supply lines 7*d* are connected to a control power source 35 through a high voltage driver (not shown). Surfaces of the ring electrodes 7*c* and the power supply lines 7*d* are covered with an insulating layer (not shown) with a thickness of 30 μm. With this arrangement, the insulation between the ring electrodes 7*c*, between the power supply lines 7*d*, between the ring electrodes 7*c* and the power supply lines 7*d* which are not connected to each other, and between the control electrode 7 and the toner carrier 22 or the counter electrode 24, and the like is secured.

In the substrate 7*b*, pores (piercing pores) with a diameter of 160 μm are arranged as gates 7*a* in a predetermined order. Each ring electrode 7*c* is made of a copper leaf with a thickness of 18 μm, and is placed around each gate 7*a* so as to have an inner diameter of 200 μm. The toner 5 passes through the gates 7*a*, flying from the toner carrier 22 to the counter electrode 24. 2560 gates 7*a* (that is, 2560 ring electrodes 7*c*) are formed in total, so as to substantially cover a width of a sheet 6 of A4 size and achieve a resolution of 300 dpi.

Note that the total number of the gates 7*a* is not limited to the aforementioned number, and it may be determined in accordance with specification of an individual image forming device, such as the resolution, and the size of sheets used with the image forming device. Besides, the distance between the control electrode 7 and the toner carrier 22, the size of the gates 7*a*, the material and thickness of the substrate 7*b* and the ring electrodes 7*c*, and the like are matters desirably determined respectively depending on specification of an individual image forming device, and they are not limited to the values mentioned above.

To the ring electrodes 7*c*, a pulse voltage in accordance with an image signal is applied by the control power source 35 which is connected to the ring electrodes 7*c* through the power supply lines 7*d* and the high voltage driver. More specifically, the control power source 35 applies a voltage (hereinafter referred to as "ON voltage") of, for example, 150 V to the ring electrodes 7*c*, to cause the toner 5 carried on the toner carrier 22 to pass through the ring electrodes 7*c* toward the counter electrode 24, while applies another voltage (hereinafter referred to as "OFF voltage") of, for example, −200 to the ring electrodes 7*c*, not to cause the toner 5 to pass therethrough. Accordingly, by controlling the voltage applied to the control electrode 7 in accordance with the image signal and supplying the sheet 6 on a surface of the counter electrode 24 on a side facing the toner carrier 22, a toner image in accordance with the image signal is formed on a surface of the sheet 6. Note that the control power source 35 is controlled by a control electrode signal supplied from the aforementioned image formation control unit which is not shown.

Figure 4:
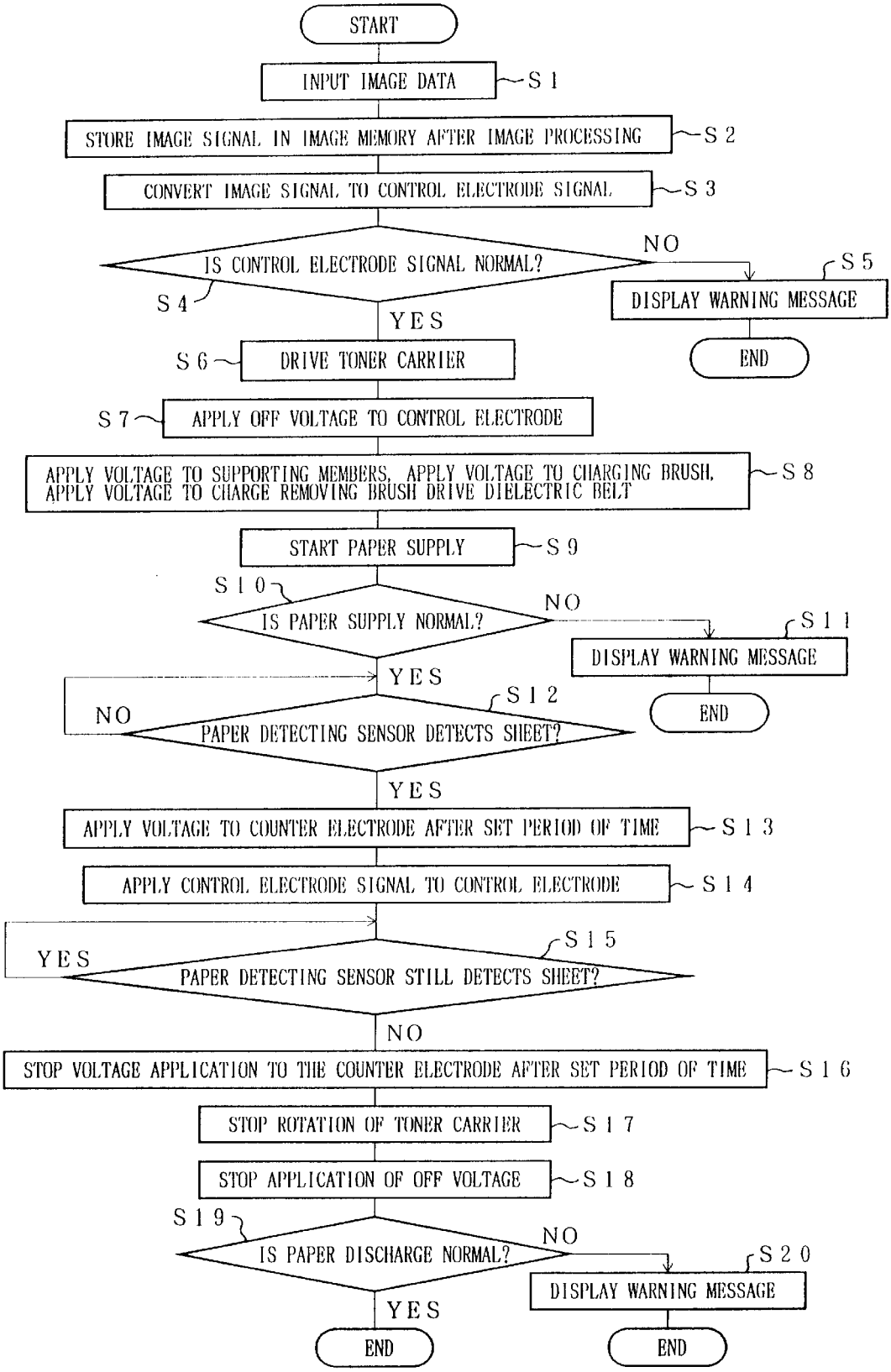
FIG. 4 is a flowchart of an image forming operation by the digital printer.

Subsequently, an image forming operation of the image forming device will be explained below, with reference to the flowchart of FIG. 4 as well as FIG. 1.

For example, a document is put on an image reading section (not shown), and a start button (not shown) is pressed, starting input of image data of the image (document) to be formed (S1). Receiving this input, the main control unit starts the image forming operation. First, the image data, which is read by the image reading section and is thus inputted, is processed by the image processing unit, and is stored as an image signal in the image memory (S2). Then, the image signal is sent to the image formation control unit, and is converted into a control electrode signal to be supplied to the control electrode 7 (S3).

When an image data quantity of the control electrode signal reaches a predetermined level, the main control unit judges whether or not the control electrode signal has abnormality (S4), and in the case where abnormality is detected, the image forming operation is suspended, while a error message is displayed to indicate occurrence of the abnormality (S5). Inversely, when no abnormality is detected on the control electrode signal, the main control unit drives the toner carrier 22 to rotate (S6), and applies an OFF voltage to the control electrode 7 (S7). Subsequently, predetermined voltages are applied to the supporting members 28*a* and 28*b*, the charging brush 29, and the charge removing brush 31, and the dielectric belt 27 is driven (S8).

Next, the main control unit drives the pickup roller 10 to rotate, so that the sheet 6 is sent from the paper cassette 9 toward the image forming unit 2 (S9). Note that in the case where normal paper supply is not carried out in sending the sheet 6 due to paper jam or the like, the abnormality in paper supply is detected by the paper sensor (S10), displaying an error message to indicate the occurrence of the abnormality (S11), and the image forming operation is suspended.

The sheet 6 sent out by the pickup roller 10 is transported to between (1) the charging brush 29 and (2) the supporting member 28*a* with the dielectric belt 27 thereon. A voltage at the same level as that applied to the counter electrode 24 by the high voltage power source 25 is applied to the supporting member 28*a*. On the other hand, a charging voltage of 1.2 kV is applied to the charging brush 29 by the charging power source 30. Therefore, negative charge is supplied to the surface of the sheet 6 which has been brought to between the charging brush 29 and the dielectric belt 27. As a result, the sheet 6 is caused to electrostatically adhere to the dielectric belt 27, and as the dielectric belt 27 moves, it is sent toward between the control electrode 7 and the counter electrode 24 in the printing section 4, reaching a position right under the gates 7*a*. The charge on the surface of the dielectric belt 27 has declined by the time the sheet 6 reaches the position below the gates 7*a*. As a result, from a relation with the potential of the counter electrode 24, the surface potential of the dielectric belt 2 becomes 2 kV.

In this state, the paper detecting sensor 34 detects a fore edge of the sheet 6 (S12), and after a predetermined time elapses since the detection, that is, when the fore edge of the sheet 6 reaches a downstream side of the counter electrode 24 in the sheet transporting direction whereby the sheet 6 comes to cover the counter electrode 24, the high voltage relay 26 becomes ON, whereby a voltage for forming a strong electric field is applied to the counter electrode 24 (S13).

Thereafter, the main control unit supplies the control electrode signal to the control electrode 7 via the control power source 35 (S14). The control power source 35 controls voltages applied to the ring electrodes 7*c*, in accordance with the control electrode signal. In other words, by appropriately applying the ON voltage and the OFF voltage selectively to the ring electrodes 7*c*, the electric field in the vicinity of the control electrode 7 is controlled. As a result, each gate 7*a* of the control electrode 7 is appropriately controlled so as to conduct the prevention, or the cancellation of the prevention, of the flight of the toner 5 from the toner carrier 22 to the counter electrode 24 in accordance with the image signal. By doing so, a toner image is formed in accordance with the image signal on the sheet 6 which is moving at a speed of 30 mm/sec toward the paper discharging side as the dielectric belt 27 on the counter electrode 24 moves.

Thereafter, the sheet 6 is further moved and goes beyond the range of detection of the paper detecting sensor 34, thereby being no longer detected by the sensor (S15). When a predetermined time has elapsed since then, that is, when a rear edge of the sheet 6 reaches an upstream side of the counter electrode 24 in the sheet transporting direction, whereby the surface (effective region) of the counter electrode 24 is about to be exposed, the high voltage relay 26 becomes OFF, thereby suspending the voltage application to the counter electrode 24 (S16).

Subsequently, the main control unit also suspends application of voltages including voltages applied to the supporting members 28*a* and 28*b*, and thereafter suspends the rotational drive of the toner carrier 22 (S17), then, also suspends the application of the OFF voltage to the control electrode 7 (S18).

On the other hand, the sheet 6 on which the toner image is formed is pealed off from the dielectric belt 27 due to a curvature of a surface of the supporting member 28*b*, and is transported to the fixing unit 12, where the toner image is fixed on the surface of the sheet 6. The sheet 6 on which the toner image is fixed is discharged onto the paper discharge tray by the paper discharge roller. Then, in the case where the paper discharge sensor detects that the sheet 6 is normally discharged (S19), the main control unit judges that the printing operation has completed in a normal state, and ends the image forming operation. Inversely, in the case where the paper discharge sensor detects that the discharge of the sheet 6 is abnormal, an error message is displayed to indicate the occurrence of abnormality (S20), and the main control unit ends the image forming operation.

Figure 5:
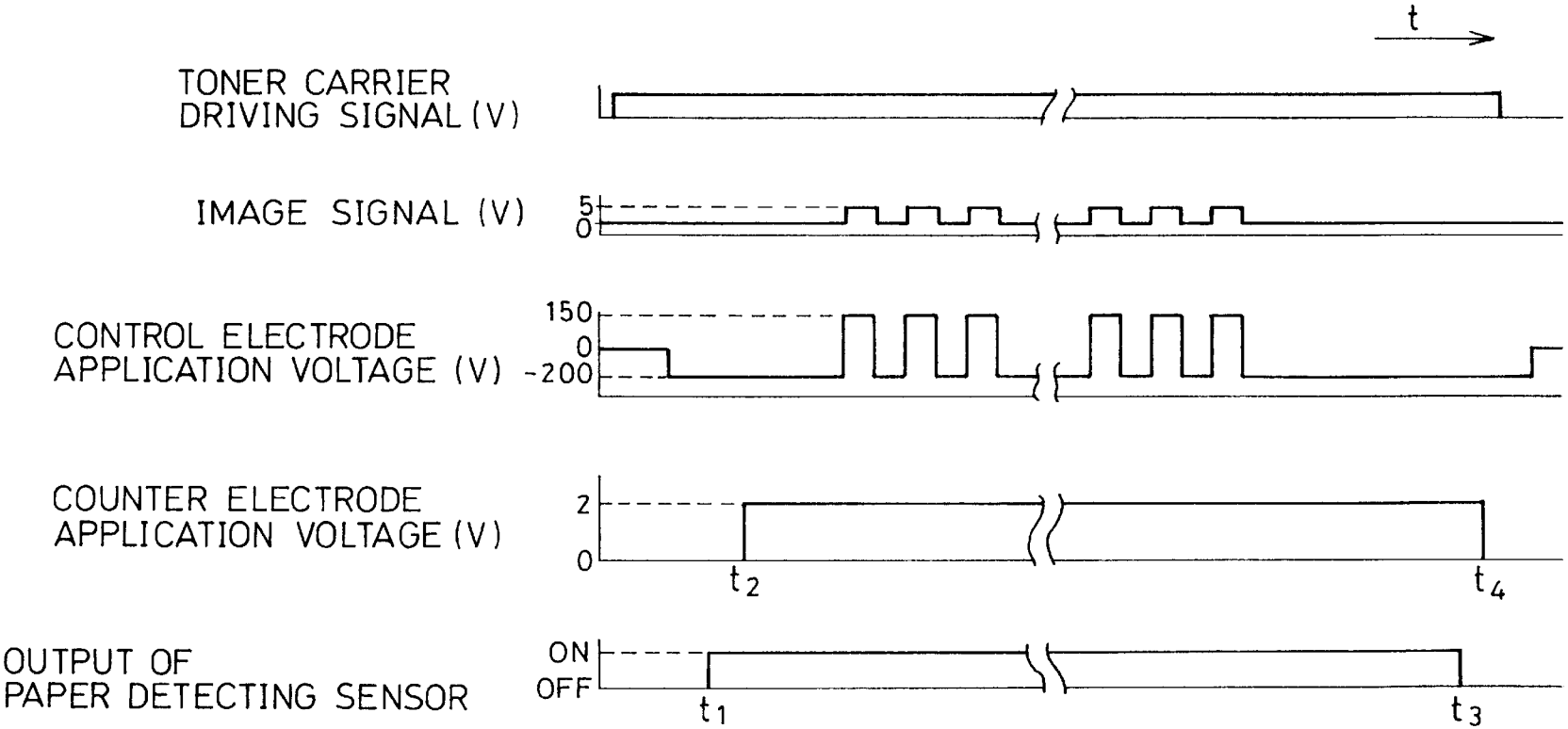
FIG. 5 is a timing chart showing timing for applying voltages to the parts of the digital printer.

Here, the following description will explain timing for application of a high voltage to the counter electrode 24 in detail, while referring to the timing chart of FIG. 5.

A digital printer in accordance with the present embodiment is arranged so that the strength of the electric field generated between the counter electrode 24 and the toner carrier 22, or between the counter electrode 24 and the control electrode 7, is controlled by ON-OFF control of application of a high voltage to the counter electrode 24.

In other words, let a time at which the rotational drive of the toner carrier 22 starts (the toner carrier driving signal is turned ON) thereby causing a level detected by the paper detecting sensor 34 to become ON (causing an output of the paper detecting sensor 34 to become ON) be a time $t_1$, and the application of a high voltage (a counter electrode application voltage=2 kV) to the counter electrode 24 by the high voltage power source 25 is started at a time $t_2$, which is later than the time $t_1$. Herein, a time interval since the time $t_1$ to the time $t_2$ is set longer than the time interval since the fore edge of the sheet 6 reaches the paper detecting sensor 34 till it reaches the downstream side of the counter electrode 24.

By doing so, the application of the voltage to the counter electrode 24 is started, not when the fore edge of the sheet 6 reaches the counter electrode 24, but after the fore edge of the sheet 6 reaches the downstream side of the counter electrode 24, that is, after the surface (effective region) of the counter electrode 24 becomes completely covered with the sheet 6 that has an excellent insulating property. As a result, an inconvenience of discharge between the counter electrode 24 and the toner carrier 22 or between the counter electrode 24 and the control electrode 7 is surely avoided.

Then, after the voltage application to the counter electrode 24, an ON voltage and an OFF voltage are applied to the control electrode 7 in accordance with an image signal. That is, in order that the image signal is turned to an ON voltage (5 V) and an OFF voltage (0 V), an ON voltage and an OFF voltage, the control electrode application voltages are turned to 150 V (an ON voltage) and −200 V (an OFF voltage), respectively.

Thereafter, a printing (image forming) operation for one page finishes, and at a time $t_4$ which is later than a time $t_3$ when the detection level of the paper detecting sensor 34 becomes OFF, i.e., an output of the paper detecting sensor becomes OFF, the application of the high voltage to the counter electrode 24 is suspended (the counter electrode application voltage=0 kV).

Then, (1) the application of high voltages to the supporting members 28*a* and 28*b*, the charging brush 29, the charge removing brush 31, and the like, and (2) the drive and voltage application with respect to the toner carrier 22 and the control electrode 7, are suspended, by the way of turning OFF the toner carrier driving signal.

A time interval from the time $t_3$ to the time $t_4$ is set shorter than a time interval which it takes for the rear edge of the sheet 6 to leave the paper detecting sensor 34 and reach the upstream side of the counter electrode 24, so that during the above time the surface (effective region) of the counter electrode 24 does not become exposed as it is transported.

By adjusting the timing for controlling the high voltage application to the counter electrode 24 as described above, discharge can be avoided. However, in the case where the time interval from the time $t_1$ to the time $t_2$ is long while the time interval from the time $t_3$ to the time $t_4$ is short, the image forming region with respect to the sheet 6 becomes narrower. Therefore, in this case, the times $t_2$ and $t_4$ at which the high voltage applied to the counter electrode 24 is turned ON and OFF respectively may be appropriately set, in accordance with the transporting speed of the sheet 6, the width (a dimension in the sheet transporting direction) of the counter electrode 24, a distance between the counter electrode 24 and the paper detecting sensor 34, and the like, which may vary depending on individual arrangements of the image forming devices.

As has been described, the digital printer in accordance with the present embodiment is arranged so that the application of the high voltage to the counter electrode 24 is carried out exclusively in the case the counter electrode 24 is completely covered with the sheet 6, and the voltage application is not conducted at other times. In other words, the digital printer in accordance with the present embodiment is characterized in that the strength of the electric field between the counter electrode 24 and the toner carrier 22, or between the counter electrode 24 and the control electrode 7 is controlled by the main control unit, the high voltage relay, and the like, so that: (1) it is set to a level required for the image formation in the case where the sheet 6 covers the whole surface (effective region) of the counter electrode 24; and (2) when the surface of the counter electrode 24 is uncovered, the strength of the electric field is weakened to a level lower than that required for the image formation, or the electric field is not generated.

Herein, unlike the above arrangement, discharge tends to occur between the counter electrode 24 and the toner carrier 22, or between the counter electrode 24 and the control electrode 7, when the high voltage is applied to the counter electrode 24 before the time $t_2$, and when the application of the high voltage continues even after the time $t_4$. To be more specific, in such cases, the sheet 6 does not exist between the counter electrode 24 on one hand and the toner carrier 22 and the control electrode 7 on the other hand, whereby the surface of the counter electrode 24 is exposed to the toner carrier 22 and the control electrode 7. This results in that the high voltage is applied to the counter electrode 24 in a state where the counter electrode 24 is uncovered with the sheet 6, and therefore, discharge tends to occur between the counter electrode 24 and the toner carrier 22, or between the counter electrode 24 and the control electrode 7.

However, as to the digital printer in accordance with the present embodiment, the discharge is surely avoided, by utilizing the aforementioned arrangement.

Note that the digital printer in accordance with the present embodiment has the paper detecting sensor 34 on the upstream side of the counter electrode 24, so that the timing of applying the high voltage to the counter electrode 24 is adjusted by detecting, by the paper detecting sensor 34, whether or not the sheet 6 is at a position where it covers the counter electrode 24. However, the arrangement for the timing for applying the high voltage to the counter electrode 24 is not limited to the foregoing arrangement.

More specifically, in the case where the sheet 6 is transported at a constant speed and the sheets 6 have a uniform length in the transporting direction, a time interval $T_1$ since the drive of the pickup roller 10 to rotate starts until the fore edge of the sheet 6 reaches the downstream side of the counter electrode 24, and a time interval $T_2$ since the drive of the pickup roller 10 to rotate starts until the rear edge of the sheet 6 reaches the upstream side of the counter electrode 24, are constant, respectively. Therefore, the digital printer may be arranged as follows, instead of having the foregoing arrangement: the high voltage is applied to the counter electrode 24 after the time interval $T_1$ has elapsed since the start of rotation of the pickup roller 10, and the application of the high voltage to the counter electrode 24 is suspended immediately before the time interval $T_2$ has elapsed since the start of rotation of the pickup roller 10. In this case as well, like the aforementioned arrangement, it is possible to apply the high voltage to the counter electrode 24 exclusively when the counter electrode 24 is completely covered with the sheet 6.

The timing for the above-described voltage application may be adjusted by detecting changes in a quantity of electric current running through the charging brush 29. More specifically, the quantity of electric current running through the charging brush 29 alters depending on whether or not the charging brush 29 contacts the sheet 6. In the case where the sheet 6 is transported at a constant speed and the sheets 6 have the uniform length in the transporting direction, a time interval $T_3$ since the sheet 6 starts contacting the charging brush 29 until the fore edge of the sheet 6 reaches the downstream side of the counter electrode 24, and a time interval $T_4$ since the sheet 6 starts not contacting the charging brush 29 until the rear edge of the sheet 6 reaches the upstream side of the counter electrode 24, are constant, respectively. Therefore, the digital printer may be arranged as follows, instead of having the foregoing arrangements: the high voltage is applied to the counter electrode 24 after the time interval $T_3$ has elapsed since the sheet 6 starts contacting the charging brush 29, and the application of the high voltage to the counter electrode 24 is suspended immediately before the time interval $T_3$ has elapsed since the sheet 6 comes to no longer contact the charging brush 29. In this case as well, like the aforementioned arrangements, it is possible to apply the high voltage to the counter electrode 24 exclusively when the counter electrode 24 is completely covered with the sheet 6.

As has been described, by using the transporting means for transporting the sheet 6 as the detecting means for detecting the sheet 6, that is, by making the transporting means have a function as the detecting means as well, the number of constituent parts can be reduced, thereby enabling the reduction of size of the device and the lowering of costs of the device.

Furthermore, the digital printer in accordance with the present embodiment is arranged so that the start and suspension of the application of the high voltage to the counter electrode 24, that is, a switching operation, is executed by using the high voltage relay 26 provided between the high voltage power source 25 and the counter electrode 24. Therefore, the voltage applied to the counter electrode 24 is stable all the time, also stabilizing the strong electric field generated on the surface of the counter electrode 24. For this reason, excellent image formation is realized by the digital printer.

The switching operation is, however, realized as well by using a known switching circuit, in the place of the high voltage relay 26. For example, by using as the high voltage power source 25 a power source whose output is not destabilized by ON-OFF actions and which is capable of outputting a high voltage immediately after the start of its high voltage outputting operation, the high voltage to be applied to the counter electrode 24 is controlled by ON-OFF control with respect to the output of the high voltage power source 25 or with respect to power supply to the high voltage power source 25. In this case, there is no need to provide the high voltage relay 26, thereby enabling a further decrease in the number of the constituent parts. As a result, further reduction of the size of the device, and further lowering of the costs of the device can be achieved.

Besides, the digital printer may use a variable resistor, in lieu of the high voltage relay 26. More specifically, by appropriately varying a resistance of the variable resistor, the high voltage applied to the counter electrode 24 is controlled, whereby the application and the suspension of application of the high voltage to the counter electrode 24, that is, the switching operation, is carried out. In the case where the switching is conducted by using the high voltage relay 26, electric noises tend to be generated, thereby causing the control circuit to erroneously operate. Inversely, by using the variable resistor, the occurrence of the noises can be suppressed. Therefore, an arrangement wherein the variable resistor is used is more preferable.

Furthermore, the digital printer in accordance with the present embodiment is designed so that the strength of the electric field between the counter electrode 24 and the toner carrier 22, or between the counter electrode 24 and the control electrode 7, is controlled by the ON-OFF control of the high voltage applied to the counter electrode 24. However, the arrangement for controlling the strength of the electric field should not be limited to the above arrangement.

Figure 6:
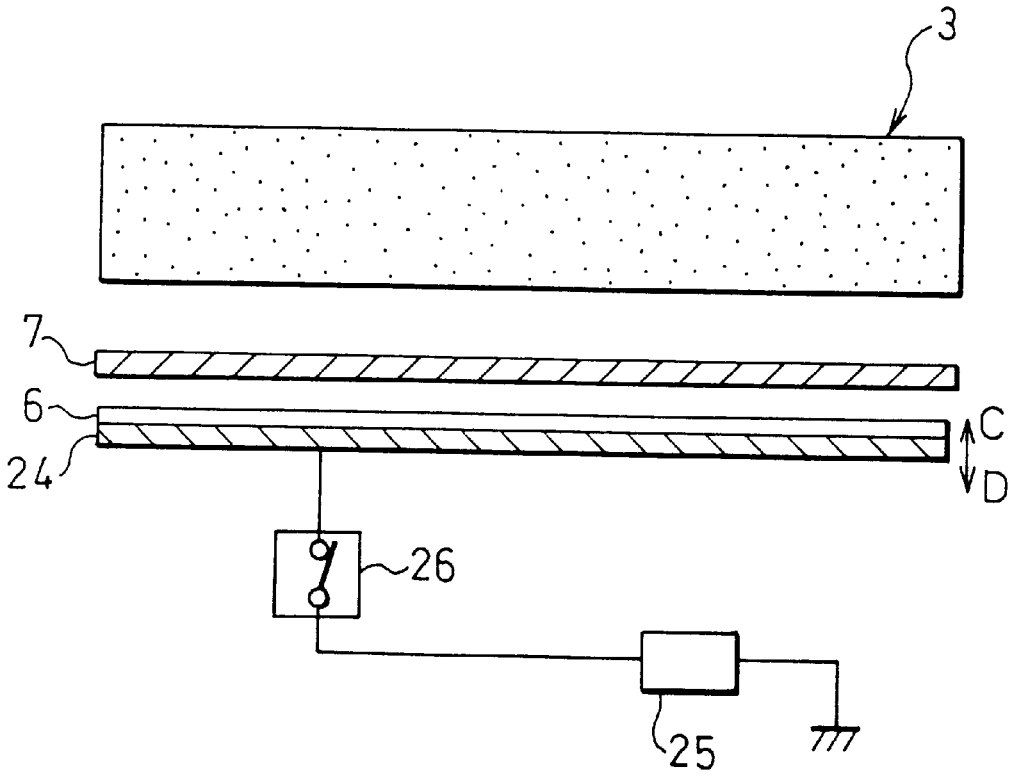
FIG. 6 is a view illustrating another arrangement of a counter electrode provided in the digital printer.

For example, as shown in FIG. 6, the counter electrode 24 may be movably provided so as to move in a vertical direction which is a direction perpendicular to the sheet transporting direction (indicated by the arrows C and D in FIG. 6). In this case, the counter electrode 24 is moved in a direction (the arrow C direction) such that it comes closer to the control electrode 7, during a time interval after the sheet 6 is transported to a facing region between the control electrode 7 and the counter electrode 24 until the image formation with respect to the sheet 6 starts. On the other hand, the counter electrode 24 is moved in a direction (the arrow D direction) such that it goes apart from the control electrode 7, after the image formation with respect to the sheet 6 finishes and the sheet 6 is sent away from the facing region. In the case where the counter electrode 24 is movably provided, that is, the distance from the counter electrode 24 to the control electrode 7 and the toner carrier 22 is made variable, the electric field can be weakened by moving the counter electrode 24 away from the control electrode 7, even though the voltage applied to the counter electrode 24 is constant. Therefore, discharge scarcely occurs. The counter electrode 24 may be linearly moved, or may be rotated. In short, a scheme for moving the counter electrode 24 may be determined depending on properties of an individual image forming device.

In the above description, a case where the ON voltage applied to the control electrode 7 for causing the toner 5 to pass therethrough is set to 150 V is explained, but an optimal value of the ON voltage varies depending on the properties of the toner 5, the structure of the image forming unit 2, and the like. Therefore, the ON voltage is not limited to the foregoing value. Optimal values of the voltage applied to the counter electrode 24, the voltage applied to the charging brush 29, the surface potential of the sheet 6 immediately below the gates 7*a*, and the like, also vary depending on the properties of the toner 5, the structure of the image forming unit 2, and the like, and hence they are not limited to the aforementioned values. Furthermore, an optimal value of the OFF voltage applied to the control electrode 7 for preventing the toner 5 from passing therethrough also varies depending on the properties of the toner 5, the structure of the image forming unit 2, and the like, and hence it should not be limited to the aforementioned value, either.

On top of that, in the above description, a case where the whole surface of the counter electrode 24 is the effective region where discharge tends to occur is explained, but in the case where the effective region is smaller than the surface of the counter electrode 24 facing the control electrode 7 or the toner carrier 22, for example, in the case where the counter electrode 24 is in a roller shape, or in the case where the counter electrode 24 is greater than the control electrode 7, the aforementioned timing may be adjusted in accordance with the effective region.

Incidentally, a case where recording media of several different sizes are used as the sheets 6 in the digital printer of the aforementioned arrangement is presumed.

Figure 7:
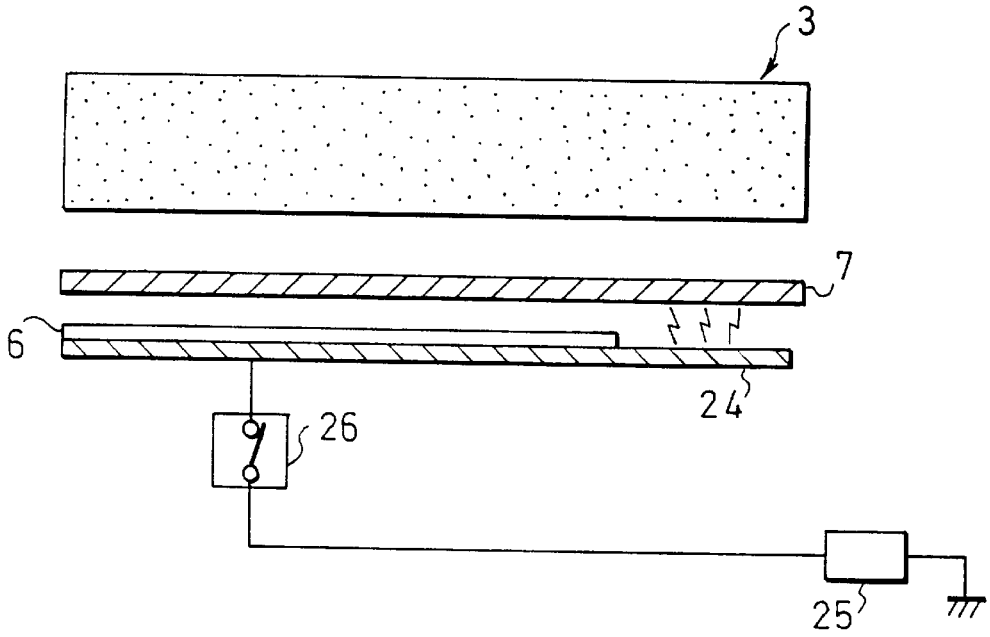
FIG. 7 is an arrangement view for explaining a problem in the case where a sheet of paper used has a smaller dimension in a direction orthogonal to a transporting direction than a dimension of the counter electrode in the same direction.

In the digital printer in which, for example, the sheets 6 of A4 size are used, the counter electrode 24 is required to have at least a width equal to a width of the A4-size paper (a dimension of the sheet 6 in a horizontal direction orthogonal to the sheet transporting direction). However, in the case where a sheet 6 of B5-size paper is used with respect to the counter electrode 24 having the width equal to the width of A4-size paper, a part of the counter electrode 24 is exposed to the toner carrier 22 of the toner supply section 3 and the control electrode 7, as shown in FIG. 7. Therefore, if a voltage is applied to the counter electrode 24 in this condition, discharge may possibly occur.

Then, in such a case, the digital printer is preferably arranged so as to have a system for, in accordance with the width of the sheet 6 used, changing a region where the strong electric field is formed between the counter electrode 24 and the toner carrier 22, or between the counter electrode 24 and the control electrode 7, as shown in FIGS. 8 through 11.

Figure 8:
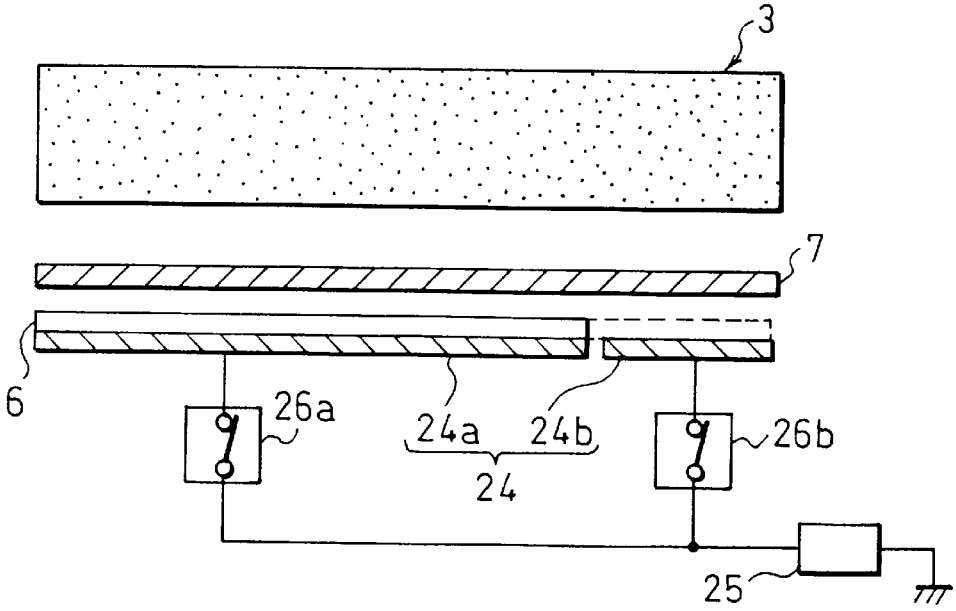
FIG. 8 is a view illustrating still another arrangement of the counter electrode provided in the digital printer.

More specifically, for example, an arrangement as shown in FIG. 8 may be applied, wherein the counter electrode 24 is divided into a counter electrode 24*a* and a counter electrode 24*b*, and high voltage relays 26*a* and 26*b* are provided for controlling voltages supplied from the high voltage power source 25 and applied to the counter electrodes 24*a* and 24*b*, respectively. The counter electrode 24 has a width equal to that of the A4-size paper, and the counter electrode 24*a* has a width equal to that of the B5-size paper. The counter electrode 24*a* is connected with the high voltage relay 26*a*, while the counter electrode 24*b* is connected with the high voltage relay 26*b*. Therefore, electric field region changing means is composed of the main control unit, the counter electrodes 24*a* and 24*b*, the high voltage relays 26*a* and 26*b*, and the like.

In short, the counter electrode 24 is divided into a plurality of portions in accordance with sizes of the sheets 6, and the high voltage relays 26*a* and 26*b* change the size of the electric field region using the divided counter electrodes 24*a* and 24*b* as units.

In this arrangement, when the sheet 6 of the B5-size paper is used, the high voltage relay 26*a* is turned ON while the high voltage relay 26*b* is turned OFF. By doing so, the counter electrode 24*b* is exposed to the control electrode 7 but the high voltage (toner flight voltage) is not applied thereto, and hence discharge can be avoided. On the other hand, in the case where the sheet 6 of A4 size is used, the high voltages 26*a* and 26*b* both are turned ON. By doing so, the high voltage is applied to the counter electrode 24*b* as well, and a strong electric field is formed by the counter electrode 24 with respect to the whole surface of the sheet 6.

Note that in the arrangement shown in FIG. 8, the application of the high voltage with respect to the counter electrodes 24*a* and 24*b*, and the cancellation of the voltage application, are carried out by ON-OFF control with respect to the high voltage relays 26*a* and 26*b*. However, if the ON-OFF control is conducted with respect to the high voltage relays 26*a* and 26*b*, electric noises tend to be generated, thereby possibly causing the control circuit to erroneously operate. In this case, the digital printer may use variable resistors, in lieu of the high voltage relays 26*a* and 26*b*. More specifically, by appropriately varying resistances of the variable resistors, the high voltage applied to the counter electrodes 24*a* and 24*b* is controlled, whereby the application and the suspension of application of the high voltage to the counter electrodes 24*a* and 24*b*, that is, the ON-OFF control (voltage raising-lowering control), is carried out. The potentials of the variable resistors during the voltage lowering control may be set to values such that the occurrence of discharge can be avoided.

Figure 9:
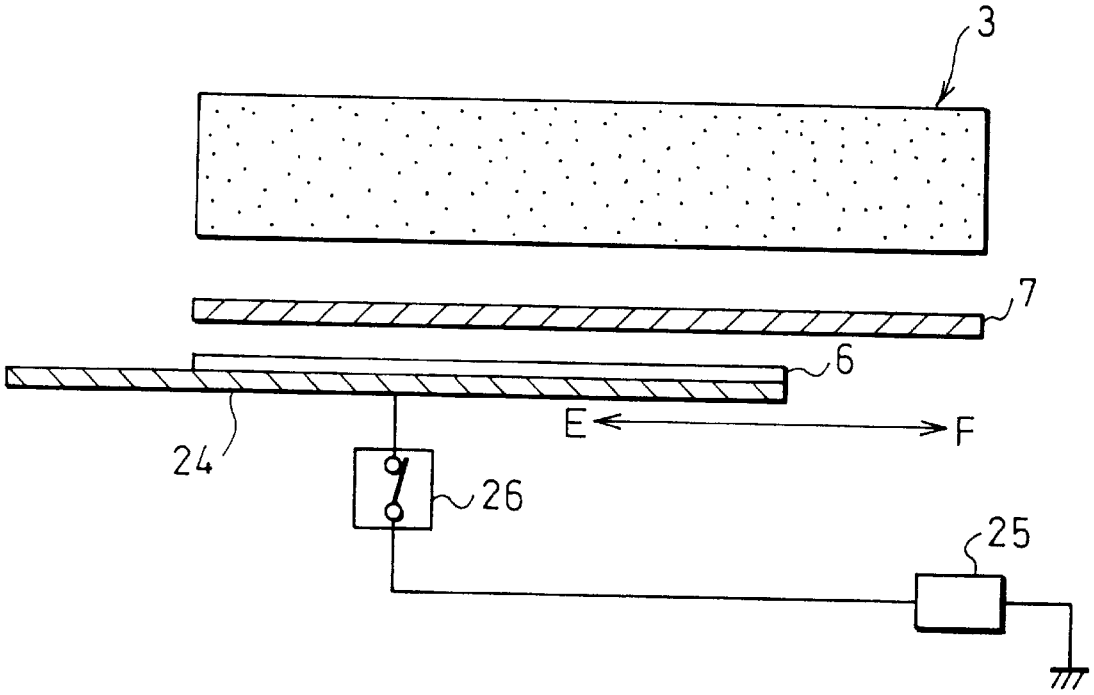
FIG. 9 is a view illustrating still another arrangement of the counter electrode provided in the digital printer.

On the other hand, the size of the electric field region may be changed by moving the counter electrode 24 in the sheet transporting direction. More specifically, as shown in FIG. 9, the counter electrode 24 may be movably provided so as to move in the sheet transporting direction (indicated by arrows E and F in FIG. 9). The counter electrode 24 detects a width of the sheet 6 by using a sensor not shown, and a size (width) of a portion of the counter electrode 24 which faces the control electrode 7 is changed in accordance with the width (size) of the sheet 6.

In this arrangement, in the case where the sheet 6 is narrow, the counter electrode 24 is moved in a direction (the arrow E direction) such that the portion thereof facing the control electrode 7 becomes smaller, while in the case where the sheet 6 is wide, the counter electrode 24 is moved in a direction (the arrow F direction) such that the portion thereof becomes greater. By doing so, the counter electrode 24 is capable of avoiding the discharge, irrespective of the width of the sheet 6.

Furthermore, a system for changing the size of the electric field region may be realized by arranging the counter electrode 24 so that a distance from the toner carrier 22 or the control electrode 7 is altered with respect to a portion of the counter electrode 24. In other words, a portion of the counter electrode 24 is arranged so as to be estranged from the toner carrier 22 and the control electrode 7, in accordance with the width of the sheet 6. More specifically, to arrange the digital printer so that the sheets 6 of the B5 size and A4 size can be used, the counter electrode 24 is arranged so as to have a counter electrode surface 24*c* having a width equal to that of the B5-size paper and a counter electrode surface 24*d* having a width equal to that of the A4-size paper.

Figure 10:
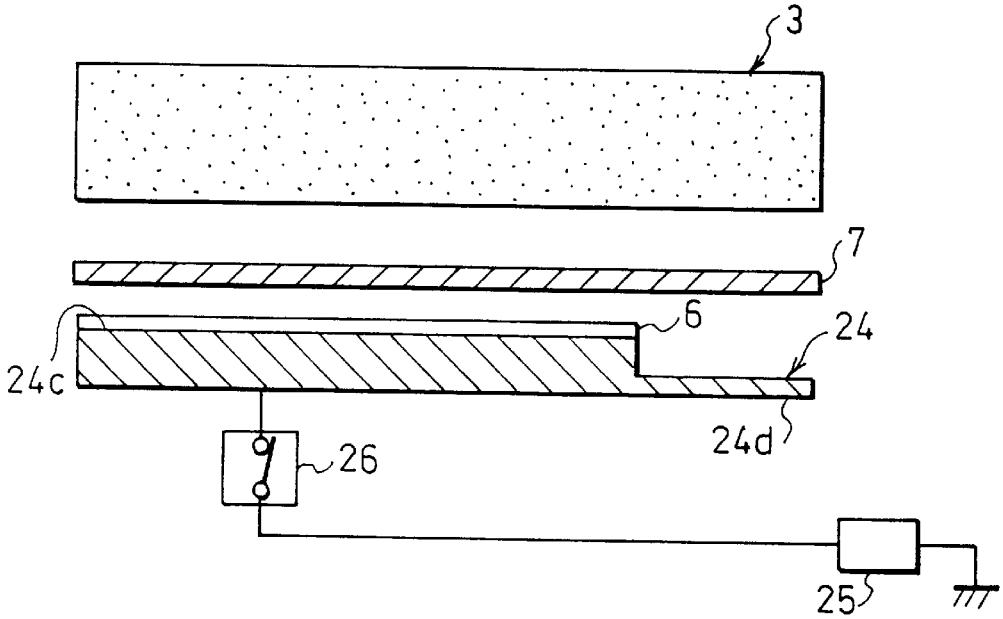
FIG. 10 is a view illustrating still another arrangement of the counter electrode provided in the digital printer, in the case where a sheet of B5-size paper is placed thereon.
Figure 11:
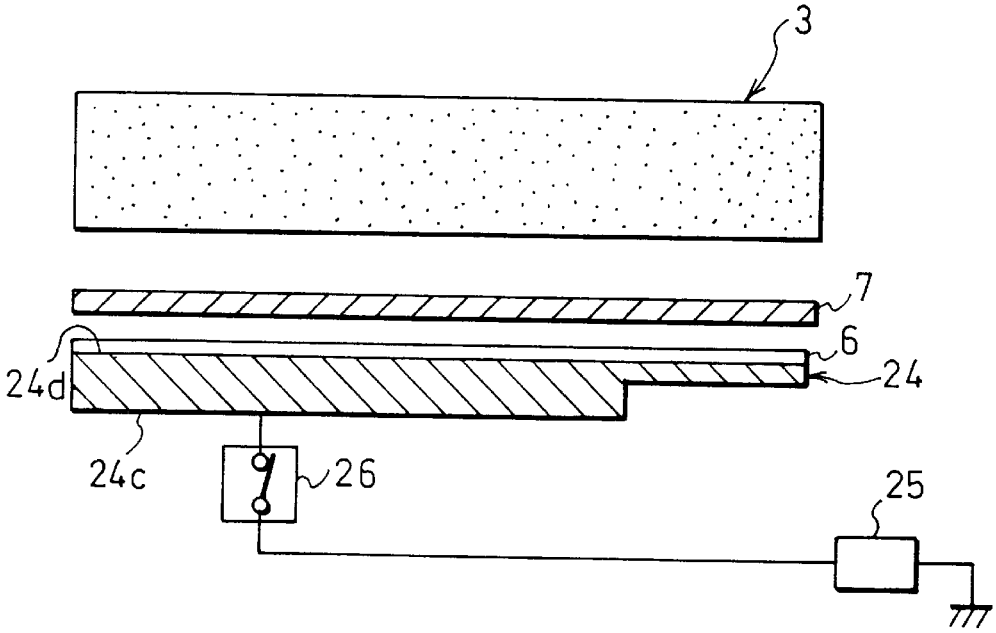
FIG. 11 is a view showing the counter electrode shown in FIG. 10, in the case where an A4-size sheet of paper is placed thereon.

In this arrangement, the counter electrode 24 is turned over, so that either the counter electrode surface 24*c* or the counter electrode surface 24*d*, which has a width conforming with the width of the sheet 6 now used, faces the control electrode 7. By doing so, the facing region where the strong electric field is formed is controlled. More specifically, in the case where the sheet 6 of B5 size is used, the counter electrode surface 24*c* is caused to face the control electrode 7, as shown in FIG. 10. Then, when the sheet 6 of A4 size is used, the counter electrode 24 is turned over, and the counter electrode surface 24*d* is caused to face the control electrode 7, as shown in FIG. 11. Thus, since in the case where the sheet 6 of B5 size is used, a part of the counter electrode 24 is estranged from the toner carrier 22 and the control electrode 7, the electric field formed in this region becomes weaker, thereby enabling avoidance of the discharge.

As has been described above, the arrangement wherein the position relationship between the control electrode 7 and the counter electrode 24 is appropriately changed is adopted to the digital printer in accordance with the present embodiment, and therefore, the digital printer is capable of avoiding discharge.

Figure 12:
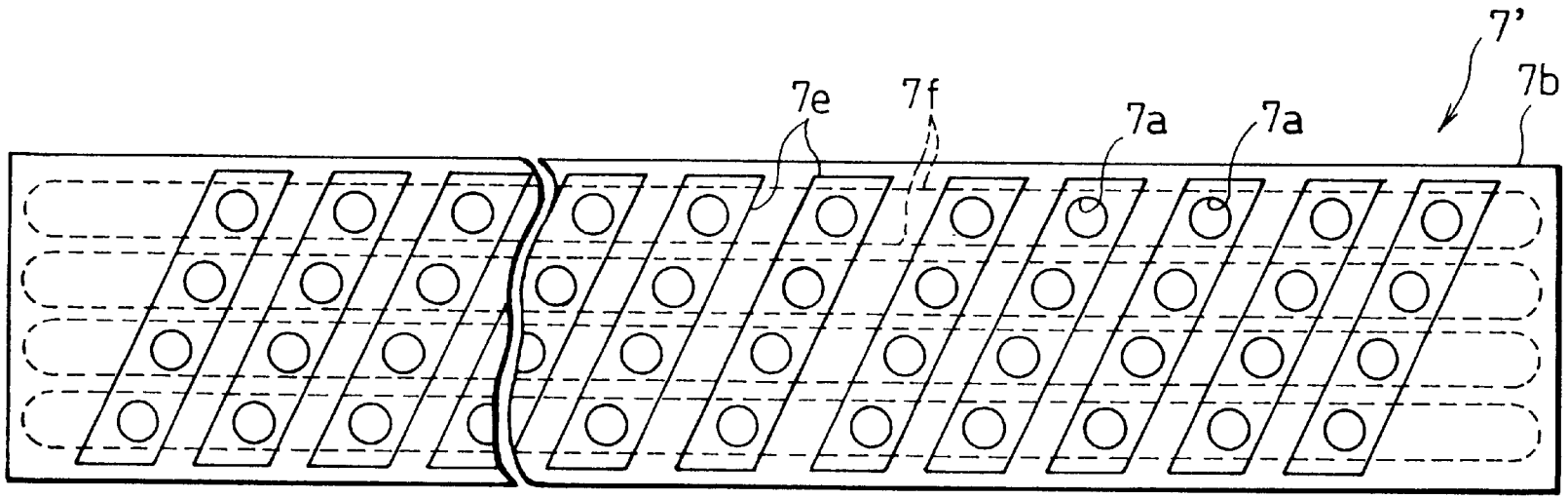
FIG. 12 is a plan view illustrating another arrangement of the control electrode provided in the digital printer.

The present embodiment is explained by taking as an example a case where the control electrode 7 is controlled by the single drive control method wherein each gate 7*a* is controlled with the use of each ring electrode 7*c* which is independent from each other. However, the control method should not be limited to it, and the matrix control method can be applied. In other words, in lieu of the control electrode 7 having the ring electrodes 7*c*, as shown in FIG. 12, a control electrode 7' may be used, which is arranged so as to have belt-shape electrodes 7*e* on a surface of the insulating substrate 7*b* facing the toner carrier 22 and belt-shape electrodes 7*f* on the other surface thereof facing the counter electrode 24 so that gates 7*a* pierce the belt-shape electrodes 7*e* and 7*f*. The control electrode 7' utilizes the matrix control method, whereby the gates 7*a* are controlled by the belt-shape electrodes 7*e* and 7*f*.

Furthermore, the present embodiment is explained by taking a monochromatic digital printer using black toner as an example of the image forming device. However, the image forming device may be a color digital printer using a plurality of color toners. The present invention is applicable to such a color digital printer.

Figure 13:
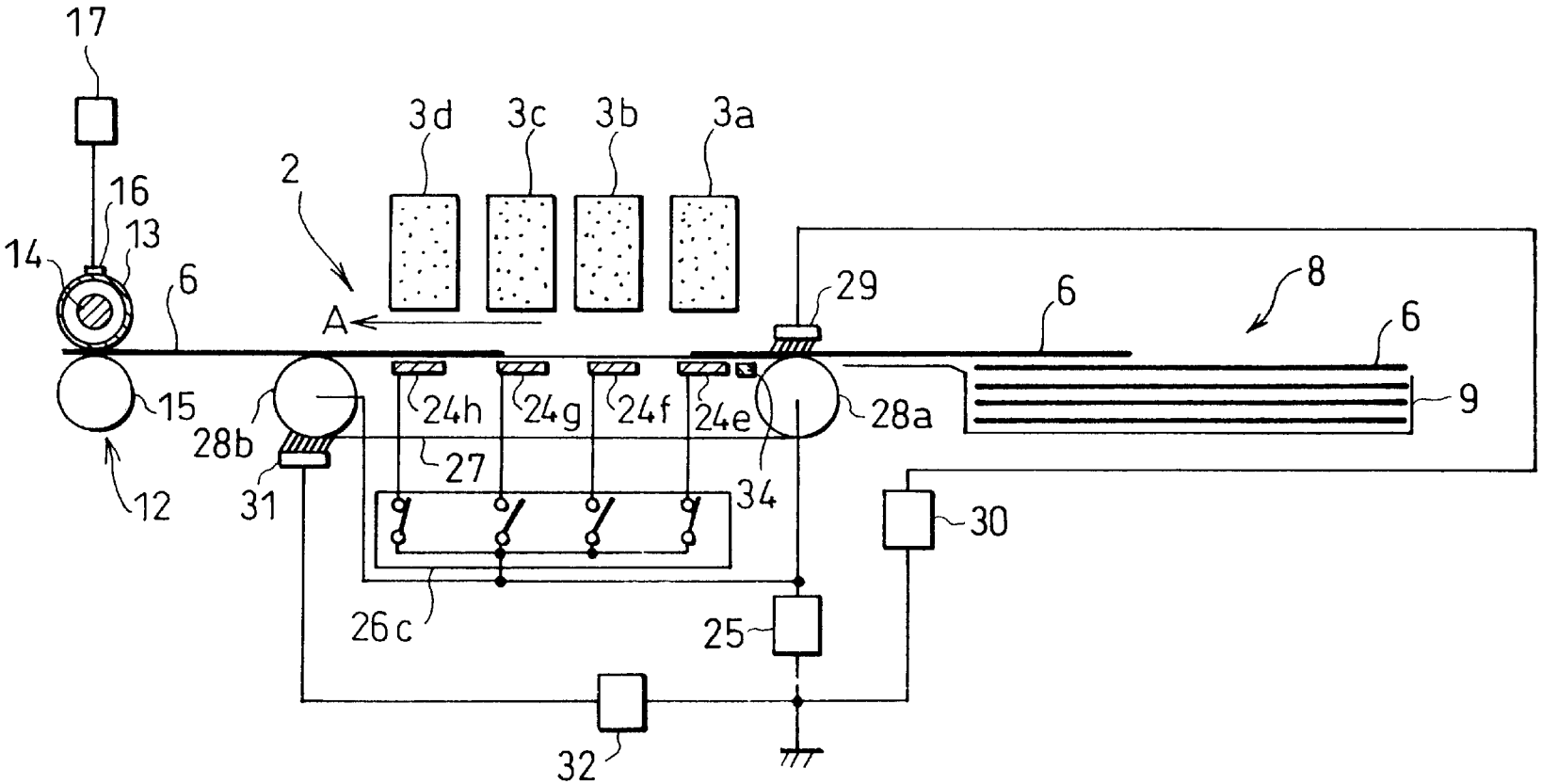
FIG. 13 is a view illustrating an arrangement of principal parts of a color digital printer in the case where the arrangement of the digital printer is applied to the color digital printer as a color image forming device.

For example, as shown in FIG. 13, a color digital printer using four color toners is equipped with an image forming unit 2 which has toner supply sections 3*a*, 3*b*, 3*c*, and 3*d*, four control electrodes (not shown) which correspond to the toner supply units 3*a* through 3*d*, respectively and four counter electrodes 24*e*, 24*f*, 24*g*, and 24*h* which correspond to the toner supply units 3*a* through 3*d*, respectively. The toner supply units 3*a*, 3*b*, 3*c*, and 3*d* contain toners of yellow, magenta, cyan, and black, respectively. A switch 26*c* is equipped with four high voltage relays corresponding to the counter electrodes 24*e* through 24*h*, respectively. The high voltage relays are arranged so as to carry out ON-OFF control of the high voltage application with respect to the counter electrodes 24*e* through 24*h*, respectively. The other constituents in the color digital printer are the same as those of the monochromatic digital printer described above. Note that in a color digital printer using five or more color toners, toner supply units, control electrodes, counter electrodes, and high voltage relays are provided so that their respective numbers correspond to the number of the colors of the toner.

In the color digital printer thus arranged, as to each color, image data are supplied thereto and an image of each color is formed on the surface of the sheet 6 transported. Thus, by laminating the images of the four colors on the surface of the sheet 6, a color image is formed.

As shown in FIG. 13, in the color digital printer, the counter electrodes 24*e* through 24*h* are provided in a row in the sheet transporting direction. Therefore, for example, in the case where color images are sequentially formed with respect to a plurality of the sheets 6, the whole surface of the counter electrode 24*h* is covered with the sheet 6, while the whole surface of the counter electrode 24*f* is uncovered and the surfaces of the counter electrodes 24*e* and 24*g* are partly uncovered. In other words, the counter electrodes 24*e* through 24*h* have different surface conditions (covered, totally uncovered, or partly uncovered). Therefore, the high voltage relays of the switch 26*c* are arranged so as to, not simultaneously, but separately, conduct the ON-OFF control for the high voltage application to the counter electrodes 24*e* through 24*h*.

To arrange the high voltage relays so as to separately conduct the ON-OFF control, each of the counter electrodes 24*e* through 24*h* may be equipped with the paper detecting sensor 34, so that the ON-OFF control for the high voltage application to the counter electrodes 24*e* through 24*h* is conducted in accordance with detection signals of the paper detecting sensors 34, respectively. Alternatively, since the respective distances between the counter electrodes 24*e* through 24*h* are predetermined and unchangeable, the digital printer may be arranged as follows: as shown in FIG. 13, one paper detecting sensor 34 is provided on an upstream side of the counter electrode 24*e* which is positioned on the most upstream side, and when respective predetermined times have elapsed since the sheet 6 is detected by the paper detecting sensor 34, the ON-OFF control of the high voltage application is conducted with respect to the counter voltages 24*e* through 24*h*, respectively. By applying the arrangement, the number of the paper detecting sensors 34 is decreased, thereby enabling reduction of the number of constituent parts. As a result, the reduction of the size of the device, and the manufacturing costs is achieved.

In the color digital printer of the above arrangement as well, like the aforementioned monochromatic digital printer, the counter electrodes 24*e* through 24*h* may be movably provided so as to move in a vertical direction which is orthogonal to the sheet transporting direction (this arrangement corresponds to the arrangement shown in FIG. 6). Alternatively, each of regions where strong electric fields between the counter electrodes 24*e* through 24*h* and the toner carrier 22, or between the counter electrodes 24*e* through 24*h* and the control electrodes, respectively, are formed may be changed in accordance with the width of the sheet 6 used (this arrangement corresponds to the arrangement shown in FIGS. 8 through 11).

The present embodiment is explained by taking as an example the digital printer which uses toner as a developer, but the developer is not limited to toner, and it may be ink.

Furthermore, the toner supply unit 3 may be arranged so that the ion flow method is applied thereto. In other words, the image forming unit 2 may be equipped with an ion source such as a corona charger. In this case as well, the adhesion of the developer to the sheet 6 can be controlled, by controlling the applied voltage. Therefore, as to the digital printer thus arranged, it is possible to achieve the same effects as those depicted in the above description of the present embodiment.

As has been described so far, the image forming device of the present invention has (1) a carrier for carrying a developer, (2) a counter electrode provided vis-a-vis the carrier, and (3) a control electrode provided between the carrier and the counter electrode, the control electrode having a plurality of gates each being composed of a piercing pore and a plurality of electrodes for individually controlling passage of the developer through the gates, wherein the developer is caused to fly from the carrier to the counter electrode by an electric field generated between the carrier and the counter electrode, while the passage of the developer through the gates is controlled by an electric field generated between the carrier and control electrode, so that an image is formed on a surface of a recording medium being transported between the control electrode and the counter electrode, with the developer caused to adhere thereto, and the image forming device is characterized in comprising electric field control means for controlling the electric field generated between the counter electrode and the carrier or between the counter electrode and the control electrode, so that (i) a strength of the electric field is set to a level necessary for image formation exclusively in case the recording medium covers an effective region of the counter electrode, and (ii) in the other cases, the strength thereof is weakened to a level lower than the level necessary for image formation, or the electric field per se is eliminated.

According to the aforementioned arrangement, the electric field control means controls the electric field generated between the counter electrode and the carrier or between the counter electrode and the control electrode so that (i) the electric field has a strength necessary for image formation exclusively in the case where the recording medium covers the effective region of the counter electrode, while (ii) in the other cases, the strength of the electric field is weakened to a level lower than that necessary for image formation, or the electric field is eliminated. Note that the effective region is a region in the counter electrode facing the carrier and the control electrode where discharge may possibly occur. Therefore, the effective region varies depending on a shape of the counter electrode, and in some cases a whole surface of the counter electrode constitutes the effective region, while in other cases a part of the surface of the counter electrode constitutes the effective region.

Accordingly, whenever a strong electric field necessary for image formation is formed, whereby high insulation is required, the recording medium is made to lie between the control electrode and the counter electrode. With this arrangement, occurrence of discharge between the counter electrode and the carrier or between the counter electrode and the control electrode is surely avoided, even though the insulation therebetween is poor. In other words, in the effective region of the counter electrode, the strong electric field necessary for image formation is formed between the counter electrode and the carrier or between the counter electrode and the control electrode exclusively when the effective region is covered with the recording medium, and at other times the strong electric field is not formed. Therefore, there is no need to provide the counter electrode, the carrier, the control electrode, and the like, with either an insulating member having a high resistance or a thick insulating member additionally. Therefore, by arranging the image forming device as above, occurrence of discharge which may break such members is surely avoided with such simple arrangement.

Furthermore, as described above, the image forming device of the present invention is characterized in comprising a plurality of the carriers for carrying a plurality of developers in different colors from each other respectively, and a plurality of the control electrodes and a plurality of the counter electrodes so as to correspond to the plurality of carriers respectively, wherein the electric field control means individually controls electric fields generated between the counter electrodes and the carriers or between the counter electrodes and the control electrodes.

According to the foregoing arrangement, the electric field control means individually controls the strengths of the electric fields which are generated between the counter electrodes and the carriers or between the counter electrodes and the control electrodes respectively. Therefore, in the case where the color image is formed by conducting the operation (process) for image formation plural times, the strong electric fields necessary for image formation are individually formed between the counter electrodes and the carriers or between the counter electrodes and the control electrodes exclusively when the effective regions of the counter electrodes are covered with the recording medium, whereas the strong electric fields are not formed at other times. Therefore, by arranging the image forming device as above, even in the case where a color image is formed, occurrence of discharge which may break such members is surely avoided with such simple arrangement.

Furthermore, as described above, the image forming device of the present invention is characterized in that the electric field control means controls the strength of the electric field by altering a voltage applied to the counter electrode.

With the foregoing arrangement wherein the strength of the electric field is controlled by altering the voltage applied to the counter electrode, the driving section of the device is further reduced. By doing so, the liability of the device is further enhanced, while such simplification of the arrangement results in reduction of the number of constituent parts of the device, reduction of the size of the device, and the lowering of the costs of the device.

Furthermore, as described above, the image forming device of the present invention is characterized in that the electric field control means includes switching means for switching on and off the voltage applied to the counter electrode, the switching means being provided between the counter electrode and power supply means for supplying a voltage to the counter electrode.

According to the foregoing arrangement, the voltage applied to the counter electrode is altered by the ON-OFF action of the switching means provided between the counter electrode and the power supply means. Therefore, even immediately after the output of the high voltage from the power supply means to the counter electrode starts, the output does not become unstable, and the set desired high voltage is smoothly applied to the counter electrode immediately after the start of the output. As a result, a problem that the voltage applied to the counter electrode becomes unstable can be avoided, whereby the voltage is stabilized all the time and stable image formation is realized.

Furthermore, as has been described above, the image forming device of the present invention is characterized in that the electric field control means controls the strength of the electric field by altering a distance from the counter electrode to the carrier or the control electrode.

As the distance between the counter electrode and the carrier or the control electrode becomes greater, the electric field becomes weaker. Therefore, with the foregoing arrangement, the occurrence of discharge between the counter electrode and the carrier or between the counter electrode and the control electrode is surely avoided, while generation of electric noises is also prevented.

In addition, as has been described above, the image forming device of the present invention is characterized in that the electric field control means includes detecting means capable of detecting presence or absence of the recording medium on an upstream side of the counter electrode in a recording medium transporting direction, and the electric field control means controls the strength of the electric field based on a detection result of the detecting means.

With the above arrangement, the position of the recording medium being transported is detected by the detecting means, and the timing of the control of the electric field strength is adjusted in accordance with the detection result. Therefore, as compared with, for example, a case where the strength of the electric field is controlled depending on an elapsed time since a button for starting the image forming operation is pressed, the strength of the electric field is further surely controlled, whereby the occurrence of discharge between the counter electrode and the carrier or between the counter electrode and the control electrode is surely avoided.

Furthermore, as has been described above, the image forming device of the present invention is characterized in further comprising transporting means for transporting the recording medium, the transporting means being provided on an upstream side of the counter electrode in the recording medium transporting direction, wherein the transporting means serves as the detecting means.

Since the transporting means is generally arranged so as to be driven exclusively when it transports a recording medium, consumed power of the transporting means varies when it is driven so as to transport a recording medium and when it is not driven. Therefore, the timing for controlling the strength of the electric field can be adjusted based on changes in the consumed power. Accordingly, with the aforementioned arrangement, there is no need to additionally provide detecting means, and this results in simplification of the arrangement and reduction of the number of constituent parts. As a result, reduction of the size of the device and the lowering of costs can be achieved.

Furthermore, as has been described above, the image forming device of the present invention has (1) a carrier for carrying a developer, (2) a counter electrode provided vis-a-vis the carrier, and (3) a control electrode provided between the carrier and the counter electrode, the control electrode having a plurality of gates each being composed of a piercing pore and a plurality of electrodes corresponding to the gates respectively for controlling passage of the developer through the gates, wherein the developer is caused to fly from the carrier to the counter electrode by an electric field generated between the carrier and the counter electrode, while the passage of the developer through the gates is controlled by an electric field generated between the carrier and control electrode, so that an image is formed on a surface of a recording medium being transported between the control electrode and the counter electrode, with the developer caused to adhere thereto, and the image forming device is characterized in comprising electric field region changing means for changing a size of an electric field region where the electric field between the counter electrode and the carrier or between the counter electrode and the control electrode, necessary for image formation, is generated, so that the size selected is in conformity with a dimension of the recording medium in a direction orthogonal to a recording medium transporting direction.

According to the above arrangement, the electric field region changing means changes the size of the electric field region necessary for image formation which is formed between the counter electrode and the carrier or between the counter electrode and the control electrode, in accordance with the dimension of the recording medium in the direction orthogonal to the recording medium transporting direction. Therefore, even in the case where the dimension of the recording medium in the above-described direction is shorter than that of the counter electrode, the electric field necessary for image formation is generated exclusively in a region of the counter electrode where the recording medium lies. By doing so, the occurrence of discharge between the counter electrode and the carrier or between the counter electrode and the control electrode is surely avoided. Therefore, there is no need to provide the counter electrode, the carrier, or the control electrode with either an insulating member having a high resistance or a thick insulating member in addition. Therefore, by thus arranging the device, the occurrence of discharge which may break such members is surely avoided with such simple arrangement.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming device comprising:

a carrier for carrying a developer, a counter electrode provided vis-a-vis said carrier, a control electrode provided between said carrier and said counter electrode, said control electrode having a plurality of gates each being composed of a piercing pore and a plurality of electrodes for individually controlling passages of the developer through said gates, wherein the developer is caused to fly from said carrier to said counter electrode by an electric field generated between said carrier and said counter electrode, while the passage of the developer through said gates is controlled by an electric field generated between said carrier and control electrode, so that an image is formed on a surface of a recording medium being transported between said control electrode and said counter electrode, with the developer caused to adhere thereto, electric field control means for controlling the electric field to be generated between said counter electrode and said carrier or between said counter electrode and said control electrode, wherein said electric field control means controls the electric field to be generated so that a strength of the electric field to be generated becomes a level necessary for image formation exclusively in a case where the recording medium covers an effective region of said counter electrode, in other cases, the strength of the electric field to be generated is weakened to one of a level lower than the level necessary for image formation or the electric field to be generated per se is eliminated, and wherein the effective region is a region in said counter electrode facing said carrier and said control electrode where discharge between said counter electrode and said control electrode may possibly occur.

2. The image forming device as set forth in claim 1, comprising a plurality of said carriers for carrying a plurality of developers in different colors from each other respectively, and a plurality of said control electrodes and a plurality of said counter electrodes so as to correspond to said plurality of carriers respectively, wherein:

said electric field control means individually controls the electric field to be generated between said counter electrodes and said carriers or between said counter electrodes and said control electrodes.

3. The image forming device as set forth in claim 1, wherein said electric field control means controls the strength of the electric field to be generated by altering a voltage applied to said counter electrode.

4. The image forming device as set forth in claim 3, wherein said electric field control means includes switching means for switching on and off the voltage applied to said counter electrode, said switching means being provided between said counter electrode and power supply means for supplying a voltage to said counter electrode.

5. The image forming device as set forth in claim 4, wherein said switching means is one of a high voltage relay or a variable resistor.

6. The image forming device as set forth in claim 1, wherein said electric field control means controls the strength of the electric field to be generated by altering a distance from said counter electrode to said carrier or said control electrode.

7. The image forming device as set forth in claim 1, wherein:

said electric field control means includes detecting means capable of detecting presence or absence of the recording medium on an upstream side of said counter electrode in a recording medium transporting direction; and said electric field control means controls the strength of the electric field to be generated based on a detection result of said detecting means.

8. An image forming device as set forth in claim 7, further comprising transporting means for transporting the recording medium, said transporting means being provided on an upstream side of said counter electrode in the recording medium transporting direction, wherein:

said transporting means serves as said detecting means.

9. The image forming device as set forth in claim 8, wherein said transporting means serving as said detecting means is one of a pickup roller or charging means.

10. An image forming device comprising:

a carrier for carrying a developer, a counter electrode provided vis-a-vis said carrier, a control electrode provided between said carrier and said counter electrode, said control electrode having a plurality of gates each being composed of a piercing pore and a plurality of electrodes for individually controlling passage of the developer through said gates, wherein the developer is caused to fly from said carrier to said counter electrode by an electric field generated between said carrier and said counter electrode, while the passage of the developer through said gates is controlled by an electric field generated between said carrier and control electrode, so that an image is formed on a surface of a recording medium being transported between said control electrode and said counter electrode, with the developer caused to adhere thereto, electric field region changing means for changing a size of an electric field region where the electric field between said counter electrode and said carrier or between said counter electrode and said control electrode necessary for image formation is to be generated, and wherein the size of the electric field region is selected in conformity with a dimension of the recording medium in a direction orthogonal to a recording medium transporting direction.

11. The image forming device as set forth in claim 10, wherein:

said counter electrode is divided into a plurality of portions in accordance with the dimensions of the recording medium; and said electric field region changing means changes the size of the electric field region by utilizing the portions of said counter electrode as units.

12. The image forming device as set forth in claim 10, wherein said electric field region changing means changes the size of the electric field region by moving said counter electrode in the recording medium transporting direction.

13. The image forming device as set forth in claim 10, wherein said electric field region changing means changes the size of the electric field region by altering a distance from a portion of said counter electrode to said carrier or said control electrode.

14. The image forming device as set forth in claim 10, wherein said electric field region changing means is a high voltage relay or a variable resistor.

* * * * *